US006637699B2

(12) United States Patent
Banks et al.

(10) Patent No.: US 6,637,699 B2
(45) Date of Patent: Oct. 28, 2003

(54) METHOD AND APPARATUS FOR CONTROLLING A TRAJECTORY OF A PROJECTILE

(75) Inventors: Johnny E. Banks, Venus, TX (US); Brian C. Baker, Arlington, TX (US)

(73) Assignee: Lockheed Martin Corporation, Dallas, TX (US)

( * ) Notice: Subject to any disclaimer, the term of this patent is extended or adjusted under 35 U.S.C. 154(b) by 0 days.

(21) Appl. No.: 10/105,666

(22) Filed: Mar. 25, 2002

(65) Prior Publication Data

US 2003/0178526 A1 Sep. 25, 2003

(51) Int. Cl.[7] ..... F42B 10/02
(52) U.S. Cl. ..... 244/3.21; 244/3.24
(58) Field of Search ..... 244/75 R, 3.21, 244/3.24–3.3, 301, 315

(56) References Cited

U.S. PATENT DOCUMENTS

| | | | | |
|---|---|---|---|---|
| 4,272,040 A | | 6/1981 | Bastian et al. | 244/3.22 |
| 5,048,772 A | | 9/1991 | Wisshaupt | 244/3.23 |
| 5,088,658 A | | 2/1992 | Forsmo | 244/3.21 |
| 5,320,304 A | | 6/1994 | Danielson | 244/3.22 |
| 5,433,399 A | | 7/1995 | Becker et al. | 244/3.22 |
| 5,593,109 A | | 1/1997 | Williams | 244/3.21 |
| 5,975,461 A | | 11/1999 | Ullrich | 244/3.21 |
| 6,247,666 B1 | | 6/2001 | Baker et al. | 244/3.21 |
| 6,474,594 B1 | * | 11/2002 | Johnson et al. | 244/3.24 |

* cited by examiner

*Primary Examiner*—Galen L. Barefoot
(74) *Attorney, Agent, or Firm*—Williams, Morgan & Amerson, P.C.

(57) ABSTRACT

An apparatus for controlling a trajectory of a projectile includes a planetary drive train, a yaw drive assembly engaged with the planetary drive train, and a pitch drive assembly engaged with the planetary drive train. The apparatus further includes a plurality of fin assemblies linked with the planetary drive train such that, as the planetary drive train is actuated by at least one of the yaw drive assembly and the pitch drive assembly, corresponding displacements are produced in the plurality of fin assemblies.

71 Claims, 11 Drawing Sheets

METHOD AND APPARATUS FOR CONTROLLING A TRAJECTORY OF A PROJECTILE

BACKGROUND OF THE INVENTION

1. Field of the Invention

This invention relates to a method and apparatus for controlling a trajectory of a projectile.

2. Description of the Related Art

Air- or sea-going vehicles are often used to deliver a payload to a target location or to carry the payload over a desired area. For example, projectiles may be used in combat situations to deliver a payload, such as an explosive warhead, a kinetic energy penetrator, or the like, to a target to disable or destroy the target. Surveillance vehicles may carry a payload designed to sense certain conditions surrounding the vehicle, such as objects on the ground or weather activity. Such vehicles typically include a plurality of fins for controlling their trajectories during flight. Conventionally, a separate motor and power transmission assembly is provided for each of the fins. A trajectory controller may be used to drive each of the motors to achieve the desired projectile trajectory.

It is generally desirable, however, for such vehicles to be lighter in weight, rather than heavier, so that their ranges may be extended while using an equivalent amount of propellant. Further, it is generally desirable for the contents of the vehicle other than the payload, e.g., the motors, power transmission assemblies, and the like, to be more compact, so that larger payloads may be used within the body of the projectile. Generally, larger warheads may contain greater amounts of explosives or larger kinetic energy penetrators to effect greater damage to the target. Further, larger surveillance payloads may allow a greater level of information to be retrieved from the vehicle's surroundings.

The present invention is directed to overcoming, or at least reducing, the effects of one or more of the problems set forth above.

SUMMARY OF THE INVENTION

In one aspect of the present invention, an apparatus for controlling a trajectory of a projectile is provided. The apparatus includes a planetary drive train, a yaw drive assembly engaged with the planetary drive train, a pitch drive assembly engaged with the planetary drive train, and a plurality of fin assemblies linked with the planetary drive train such that, as the planetary drive train is actuated by at least one of the yaw drive assembly and the pitch drive assembly, corresponding displacements are produced in the plurality of fin assemblies.

In another aspect of the present invention, an apparatus for controlling a trajectory of a projectile is provided. The apparatus includes a planetary drive train, a roll drive assembly engaged with the planetary drive train, at least one of a yaw drive assembly engaged with the planetary drive train and a pitch drive assembly engaged with the planetary drive train, and a plurality of fin assemblies linked with the planetary drive train such that, as the planetary drive train is actuated by at least one of the roll drive assembly, the yaw drive assembly, and the pitch drive assembly, corresponding displacements are produced in the plurality of fin assemblies.

In yet another aspect of the present invention, a method for controlling a trajectory of a projectile is provided, comprising epicyclically actuating a plurality of fins using outputs from at least one of a roll actuator, a yaw actuator, and a pitch actuator.

In another aspect of the present invention, a method for controlling a trajectory of a projectile is provided, including linking a plurality of fins to a yaw actuator and a pitch actuator via a planetary gear train and driving the yaw actuator and the pitch actuator to displace the plurality of fins.

In yet another aspect of the present invention, a projectile is provided. The projectile includes a flight control system disposed within the fuselage. The flight control system includes a planetary drive train, a yaw drive assembly engaged with the planetary drive train, a pitch drive assembly engaged with the planetary drive train, and a plurality of fin assemblies extending through the fuselage and linked with the planetary drive train such that, as the planetary drive train is actuated by at least one of the yaw drive assembly and the pitch drive assembly, corresponding displacements are produced in the plurality of fin assemblies. The flight control system may further include comprising a roll drive assembly engaged with the planetary drive train, wherein as the planetary drive train is actuated by at least one of the roll drive assembly, the yaw drive assembly, and the pitch drive assembly, corresponding displacements are produced in the plurality of fin assemblies.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1:
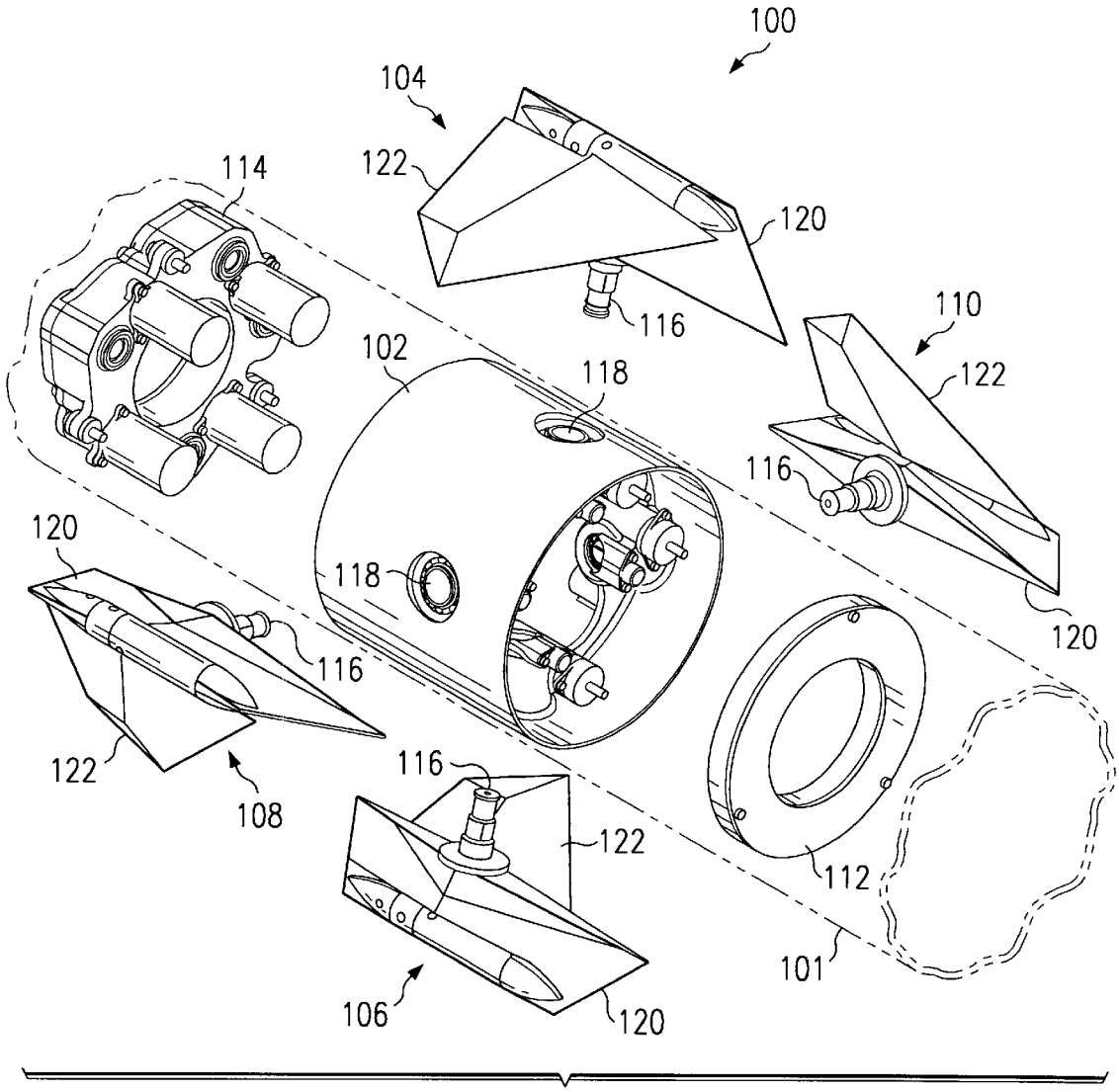
FIG. 1 is an exploded perspective view of an embodiment of a flight control system according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

FIG. 1 illustrates an embodiment of a flight control system 100 according to the present invention for use in a projectile 101 (shown in phantom) in an exploded, perspective view. The flight control system 100 includes a fin support assembly 102, a first yaw/roll fin assembly 104, a second yaw/roll fin assembly 106, a first pitch/roll fin assembly 108, a second pitch/roll fin assembly 110, a control module 112, and a drive assembly 114. Each of the fin assemblies 104, 106, 108, 110 are shown in FIG. 1 in its folded (pre-flight) configuration and is unfolded at the time of projectile deployment. In one embodiment, the flight control system 100 may control the attitudes of the fin assemblies 104, 106, 108, 110 in their unfolded configuration. The fin support assembly 102, the control module 112, and the drive assembly 114 are disposed within the projectile 101. The projectile may be a rocket, a missile, or the like that may be used to deliver a payload (e.g., an explosive warhead, a kinetic penetrator, or the like) to a target. Further, the projectile may be a surveillance vehicle, a drone, or the like that may be used to carry a payload (e.g., a reconnaissance system, a weather-sensing system, or the like) over an area to gather information about certain conditions in the area.

The control module 112 may include trajectory and fin position controllers and an electrical conditioning system (not shown in FIG. 1). The scope of the present invention, however, encompasses one or more of the trajectory and fin position controllers and the electrical conditioning system included in the control module 112. Further, the scope of the present invention encompasses an embodiment of the flight control system 100 having no control module 112, but rather having the trajectory and fin position controllers and electrical conditioning system disposed in other volumes, either together or separately, within the projectile 101.

In the illustrated embodiment, each of the fin assemblies 104, 106, 108, 110 are common to one another except for their use during flight of the projectile 101. For example, the first yaw/roll fin assembly 104 and the first pitch/roll fin assembly 108 share a common design and construction. However, the first yaw/roll fin assembly 104 is used during yaw and roll maneuvers, while the first pitch/roll fin assembly 108 is used during pitch and roll maneuvers. Accordingly, common components of the fin assemblies 104, 106, 108, 110 described and numbered commonly. However, note that this is not necessary to the practice of the invention and that alternative embodiments may employ differing designs and constructions. Each of the fin assemblies 104, 106, 108, 110 are rotatably mounted via a fin axle 116 to the fin support assembly 102 through openings (not shown) in the projectile 101 and through a corresponding plurality of openings 118 (only two shown) in the fin support assembly 102. Further, the control module 112 and the drive assembly 114 may also be mounted to the fin support assembly 102.

The trajectory of the projectile 101 may be affected by positioning the fin assemblies 104, 106, 108, 110. For example, the projectile 101 may be yawed by rotating the first yaw/roll fin assembly 104 and the second yaw/roll fin assembly 106 in the same direction. Similarly, the projectile 101 may be pitched by rotating the first pitch/roll fin assembly 108 and the second pitch/roll fin assembly 110 in the same direction. To roll the projectile 101, however, the first yaw/roll fin assembly 104 and the first pitch/roll fin assembly 108 are rotated in one direction, while the second yaw/roll fin assembly 106 and the second pitch/roll fin assembly 110 are rotated in the opposite direction. Once the fin assemblies 104, 106, 108, 110 positioned to a desired attitude, no electrical power is required to hold the fin assemblies 104, 106, 108, 110 in that attitude due to mechanical braking inherent in gearing of the flight control system 100.

Figure 2:
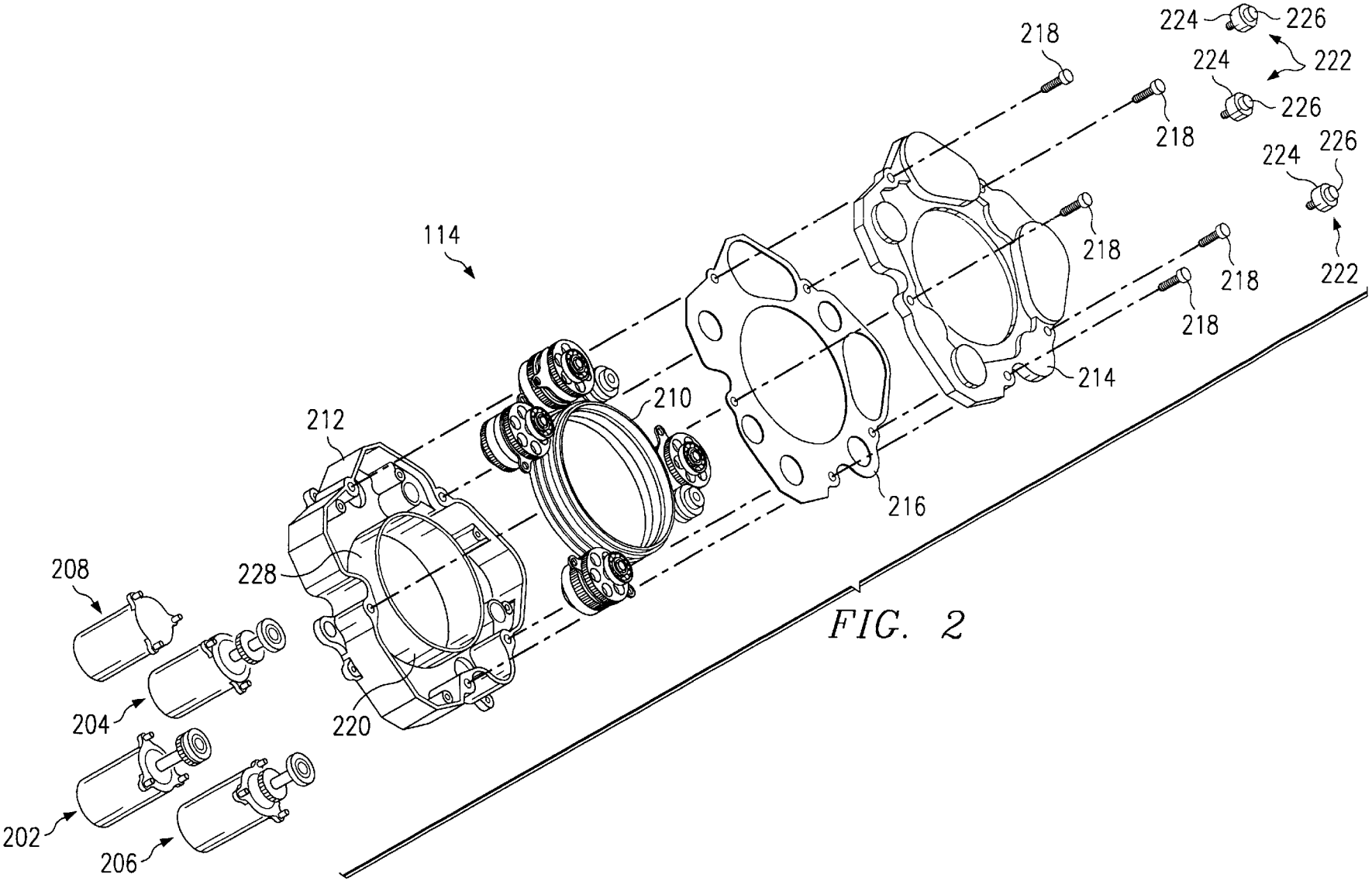
FIG. 2 is an exploded perspective view of the drive assembly illustrated in FIG. 1.

As illustrated in FIG. 2, the drive assembly 114, first shown in FIG. 1, includes a roll drive assembly 202, a yaw drive assembly 204, and a pitch drive assembly 206 that, in concert with a power source 208, translate signals from the trajectory controller into motion in an epicyclic or planetary drive train 210. Further, the drive assembly 114 comprises a gearbox 212, a gearbox cover 214, and a gearbox cover gasket 216. The power source 208 (e.g., a battery or the like), the roll drive assembly 202, the yaw drive assembly 204, and the pitch drive assembly 206 are mounted to the gearbox 212. The planetary drive train 210 is mounted within the gearbox 212. The gearbox cover gasket 216 is disposed between the gearbox 212 and the gearbox cover 214, with the gearbox cover 214 being secured to the gearbox 212 by a plurality of fasteners 218.

Figure 3:
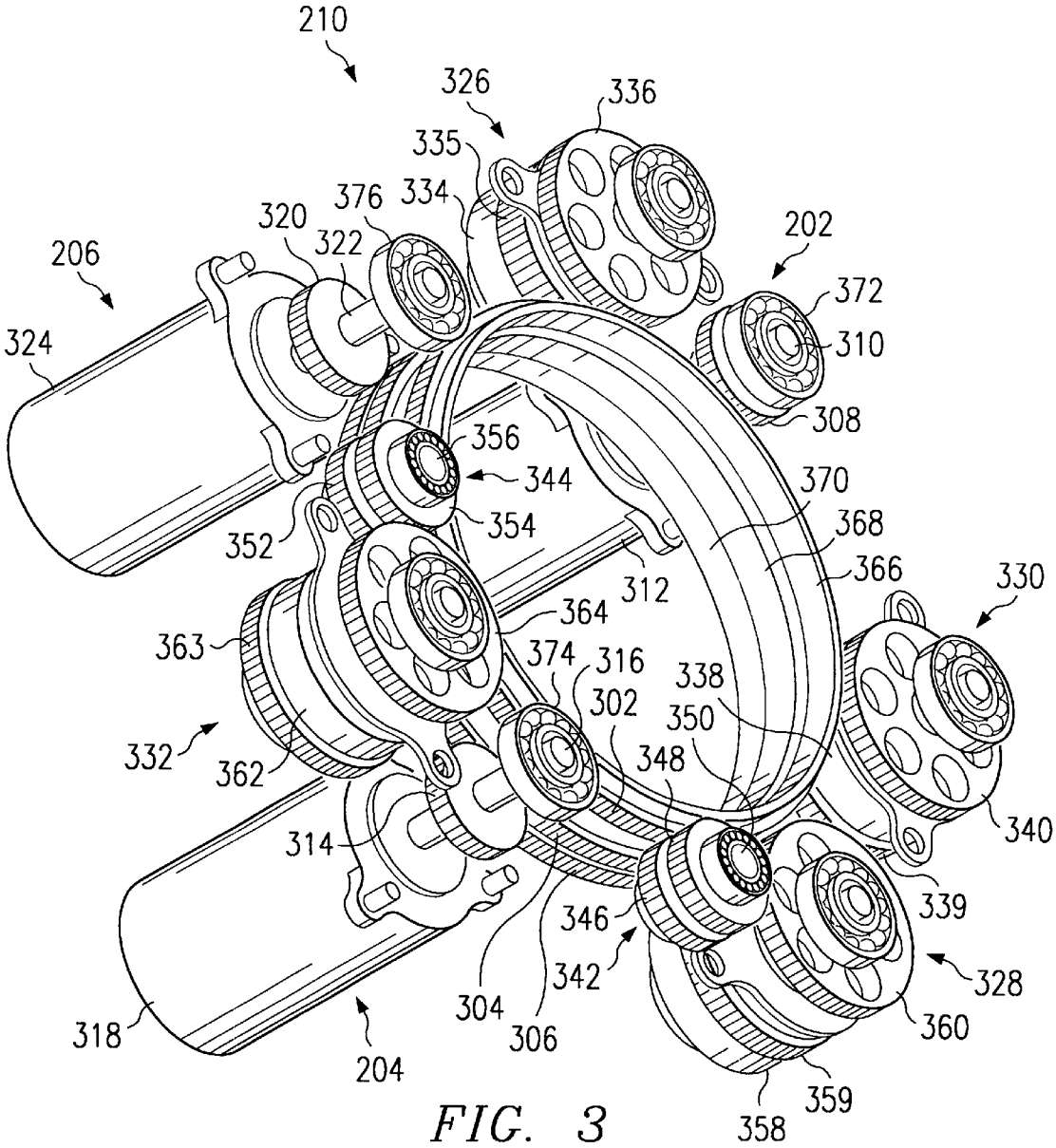
FIG. 3 is a perspective view of the planetary drive train illustrated in FIG. 2.

FIG. 3 illustrates the planetary drive train 210, the roll drive assembly 202, the yaw drive assembly 204, and the pitch drive assembly 206, all of which were first shown in FIG. 2. The roll drive assembly 202 includes a roll drive gear 308, which is connected to a roll drive motor 312 by a roll drive shaft 310. The roll drive gear 308 is engaged with a roll ring gear 302 such that, as the roll drive motor 312 rotates the roll drive shaft 310, the roll ring gear 302 is rotated. Similarly, a yaw drive assembly 204 includes a yaw drive gear 314, which is connected to a yaw drive motor 318 by a yaw drive shaft 316. The yaw drive gear 314 is engaged with a yaw ring gear 304 such that, as the yaw drive motor 318 rotates the yaw drive shaft 316, the yaw ring gear 304 is rotated. Further, the pitch drive assembly 206 includes a pitch drive gear 320, which is connected to a pitch drive motor 324 by a pitch drive shaft 322. The pitch drive gear 320 is engaged with a pitch ring gear 306 such that, as the pitch drive motor 324 rotates the pitch drive shaft 322, the pitch ring gear 306 is rotated.

Still referring to FIG. 3, the planetary drive train 210 of the drive assembly 114 also includes a first yaw/roll gear set 326, a second yaw/roll gear set 328, a first pitch/roll gear set 330, and a second pitch/roll gear set 332. Each of the gear sets 326, 328, 330, 332 are coupled with one of the fin assemblies 104, 106, 108, 110, as will be described later. The first yaw/roll gear set 326 includes a yaw gear 334 having an external gear 335 engaged with the yaw ring gear 304 and a roll gear 336 engaged with the roll ring gear 302. Thus, as the yaw ring gear 304 is rotated by the yaw drive gear 314 and the roll ring gear 302 is rotated by the roll drive gear 308, the yaw gear 334 and the roll gear 336 of the first yaw/roll gear set 326 are rotated. However, if only the yaw ring gear 304 is rotated by the yaw drive gear 314, only the yaw gear 334 is rotated. Similarly, if only the roll ring gear 302 is rotated by the roll drive gear 308, only the roll gear 336 of the first yaw/roll gear set 326 is rotated.

Further, the first pitch/roll gear set 330 includes a pitch gear 338 having an external gear 339 engaged with the pitch ring gear 306 and a roll gear 340 engaged with the roll ring gear 302. Thus, as the pitch ring gear 306 is rotated by the pitch drive gear 320 and the roll ring gear 302 is rotated by the roll drive gear 308, the pitch gear 338 and the roll gear 340 of the first pitch/roll gear set 330 are rotated. However, if only the pitch ring gear 306 is rotated by the pitch drive gear 320, only the pitch gear 338 is rotated. Similarly, if only the roll ring gear 302 is rotated by the roll drive gear 308, only the roll gear 340 of the first pitch/roll gear set 330 is rotated.

The planetary drive train 210 of the drive assembly 114 further includes a first roll reversing idler 342 and a second roll reversing idler 344. As described previously, the first yaw/roll fin assembly 104 and the first pitch/roll fin assembly 108 are rotated in one direction, while the second yaw/roll fin assembly 106 and the second pitch/roll fin assembly 110 are rotated in the opposite direction to execute a roll maneuver. Thus, the roll reversing idlers 342, 344, are provided to change the effective rotation direction of the roll ring gear 302, as will be described later. The first roll reversing idler 342 includes a first gear 346 and a second gear 348 mounted to a shaft 350. Similarly, the second roll reversing idler 344 includes a first gear 352 and a second gear 354 mounted to a shaft 356.

The second yaw/roll gear set 328 includes a yaw gear 358 having an external gear 359 engaged with the yaw ring gear 304 and a roll gear 360 engaged with the second gear 348 of the first roll reversing idler 342. Thus, as the yaw ring gear 304 is rotated by the yaw drive gear 314, the yaw gear 358 is rotated. Further, as the roll ring gear 302 is rotated by the roll drive gear 308, the first gear 346 of the first roll reversing idler 342 is rotated, which rotates the shaft 350 of the first roll reversing idler 342. The shaft 350 rotates the second gear 348 of the first roll reversing idler 342, which in turn rotates the roll gear 360 of the second yaw/roll gear set 328 in a direction opposite to that of the roll gear 336 of the first yaw/roll gear set 326.

Similarly, the second pitch/roll gear set 332 includes a pitch gear 362 having an external gear 363 engaged with the pitch ring gear 306 and a roll gear 364 engaged with the second gear 354 of the second roll reversing idler 344. Thus, as the pitch ring gear 306 is rotated by the pitch drive gear 320, the pitch gear 362 is rotated. Further, as the roll ring gear 302 is rotated by the roll drive gear 308, the first gear 352 of the second roll reversing idler 344 is rotated, which rotates the shaft 356 of the second roll reversing idler 344. The shaft 356 rotates the second gear 354 of the second roll reversing idler 344, which in turn rotates the roll gear 364 of the second pitch/roll gear set 332 in a direction opposite to that of the roll gear 340 of the first pitch/roll gear set 330.

Still referring to FIG. 3, each of the roll ring gear 302, the yaw ring gear 304, and the pitch ring gear 306 are rotatably mounted to a flange 220 (shown in FIG. 2) of the gearbox 212 via a bearing 366, 368, 370, respectively. Further, the shaft 310 of the roll drive motor 312 is supported by a bearing 372, which is in turn supported by the gearbox cover 214 (shown in FIG. 2). The shaft 316 of the yaw drive motor 318 is supported by a bearing 374, which is in turn supported by the gearbox cover 214 (also shown in FIG. 2). Additionally, the shaft 322 of the pitch drive motor 324 is supported by a bearing 376, which is in turn supported by the gearbox cover 214(shown in FIG. 2).

Figure 4:
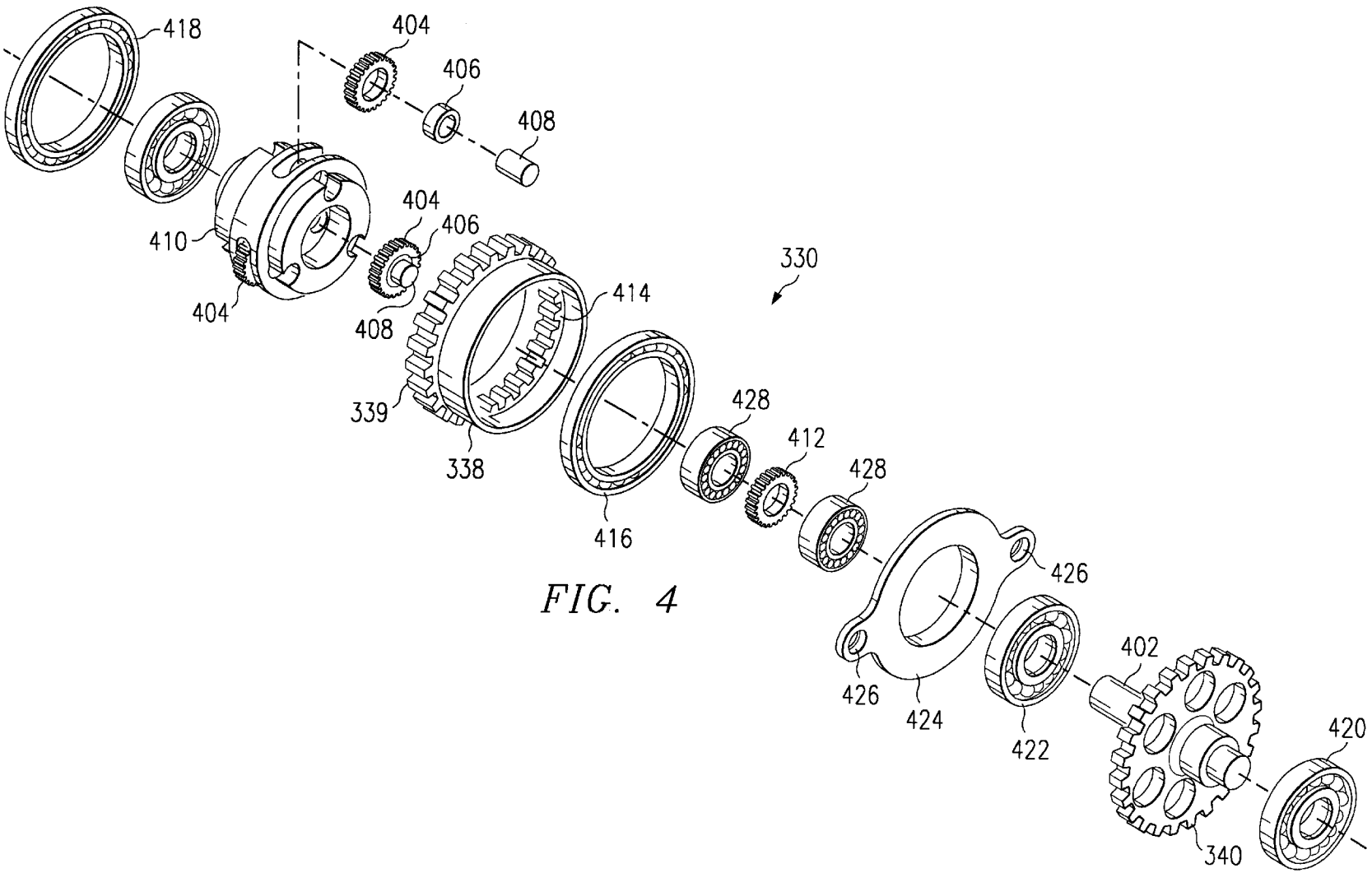
FIG. 4 is an exploded perspective view of the first pitch/roll gear set illustrated in FIG. 3.

In the illustrated embodiment, although not required for the practice of the invention, each of the first yaw/roll gear set 326, the second yaw/roll gear set 328, the first pitch/roll gear set 330, and the second pitch/roll gear set 332 have common components. FIG. 4 illustrates the first pitch/roll gear set 330 that, in this particular embodiment, is the same as the second pitch/roll gear set 332 with the exception that the roll gear 364 of the second pitch/roll gear set 332 is reversed relative to the roll gear 340 of the first pitch/roll gear set 330. The first pitch/roll gear set 330 includes the pitch gear 340 mounted to a shaft 402. The first pitch/roll gear set 330 also includes a plurality of planet gears 404 that are each rotatably mounted by a bushing 406 and a shaft 408 to a planet carrier 410. A sun gear 412 is mounted to the shaft 402 and is engaged with each of the planet gears 404 such that, as the sun gear 412 is rotated, each of the planet gears 404 are rotated. Each of the planet gears 404 is also engaged with an internal gear 414 of the pitch gear 338.

The planet carrier 410 is rotatably supported within the pitch gear 338 by a first bearing 416 and a second bearing 418. Thus, the planet carrier 410, absent any interaction between the planet gears 404 and the internal gear 414 of the pitch gear 338, is free to rotate within the pitch gear 338. The shaft 402 is rotatably supported at one end by a bearing 420 that is in turn supported by the gearbox cover 214 (shown in FIG. 2). The shaft 402 is also rotatably supported by a bearing 422 that is in turn supported by a flange 424. The flange 424 is mounted to the gearbox 212 (shown in FIG. 2) by fasteners (not shown) that extend through the openings 426 in the flange 424 and engage with the gearbox 212. The shaft 402 may also be rotatably supported by one or more bearings 428.

Thus, as the pitch gear 338 is rotated by the pitch drive gear 320(shown in FIG. 3), each of the planet gears 404 rotates. In this way, a change in roll, transmitted from the roll drive gear 308 through the roll ring gear 302, the roll gear 340, the shaft 402, and the sun gear 412 to the planet gears 404, may be mechanically combined with a change in pitch, transmitted from the pitch drive gear 320, through the pitch ring gear 306, the external gear 339 of the pitch gear 338, the internal gear 414 of the pitch gear 338, to the planet gears 404, and transmitted via the planet carrier 410.

As indicated above, each of the first yaw/roll gear set 326, the second yaw/roll gear set 328, the first pitch/roll gear set 330, and the second pitch/roll gear set 332 may have common components. For example, a yaw/roll gear set (e.g., the first yaw/roll gear set 326, the second yaw/roll gear set 328, or the like) may be made by reversing the pitch gear 338 of the first pitch/roll gear set 330 (or the pitch gear 362 of the second pitch/roll gear set 332), and vice versa. Further, the roll gear 340 on the shaft 402 may be reversed on the shaft 402 so that the second gear 348 of the first roll reversing idler 342 or the second gear 354 of the second roll reversing idler 344 may be engaged.

Figure 5:
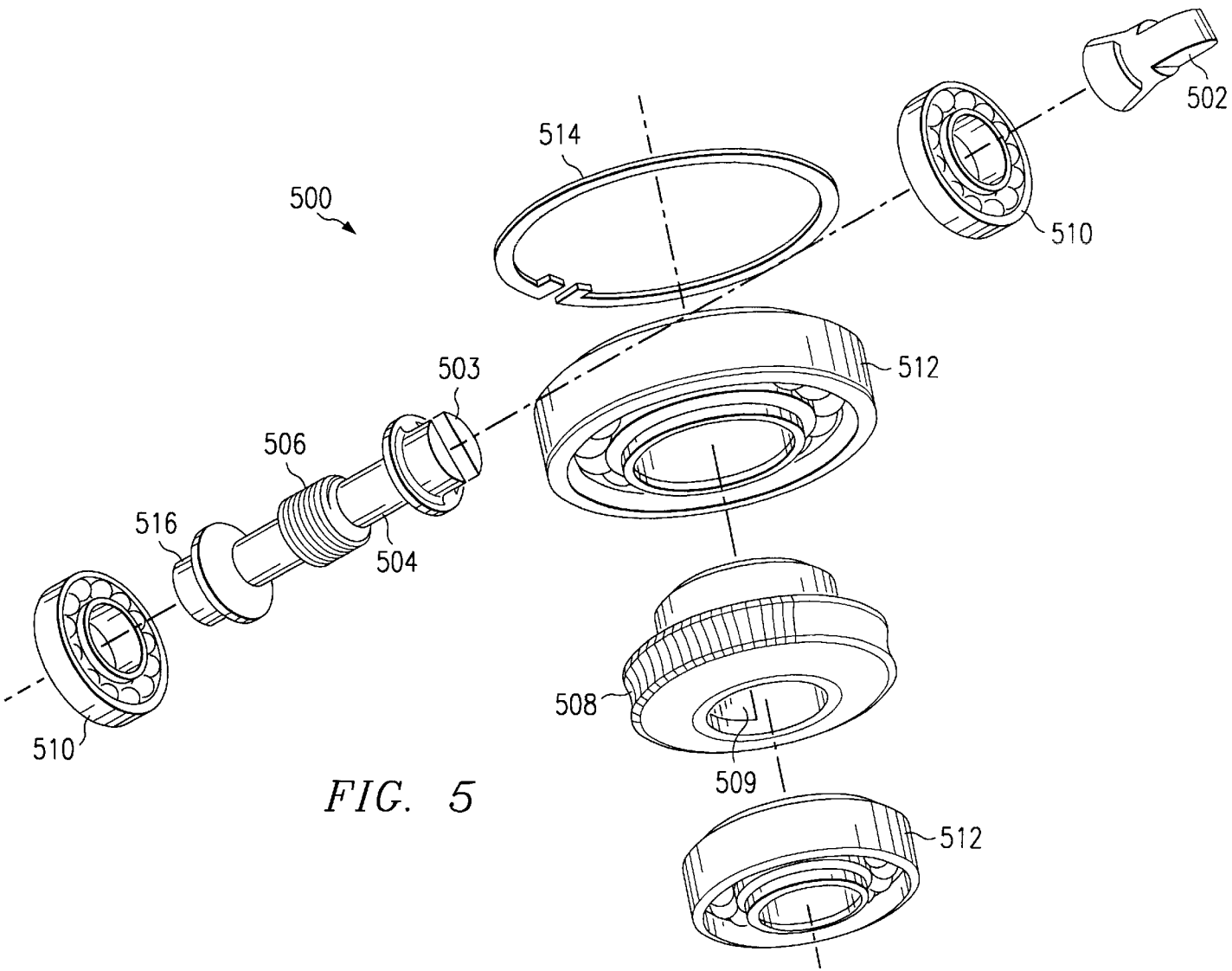
FIG. 5 is an exploded perspective view of a worm gear assembly according to the present invention.
Figure 6:
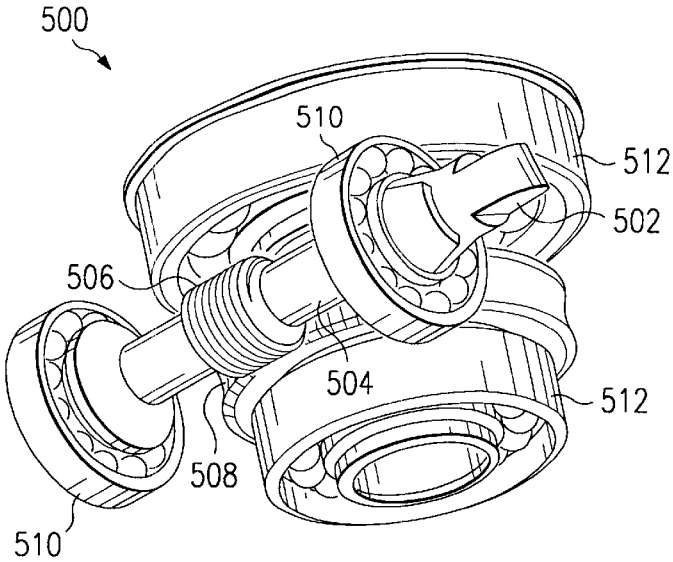
FIG. 6 is an assembled, perspective view of the worm gear assembly illustrated in FIG. 5.

The rotation of a planet carrier (e.g., the planet carrier 410 of FIG. 4 or the like) may be transmitted to one of the fin assemblies 104, 106, 108, 110 (shown in FIG. 1) by a worm gear assembly 500, as illustrated in FIG. 5 and FIG. 6 in exploded and assembled views, respectively. As applied to the pitch/roll gear set 330 of FIG. 4, a drive link 502 may be coupled with the planet carrier 410. The drive link 502 is coupled with a first end 503 of a worm shaft 504 having a worm 506. The worm 506 is engaged with a worm gear 508 that is coupled to the fin axle 116 of one of the fin assemblies 104, 106, 108, 110 (shown in FIG. 1). The worm gear 508 may be coupled with the fin axle 116 by matching splines (not shown), a key (not shown) and keyway 509, or the like. Thus, rotational motion is transmitted from the planet carrier 410, via the drive link 502, the worm shaft 504, the worm 506, and the worm gear 508 to the fin axle 116. The worm shaft 504 may be rotatably supported by one or more bearings 510, which may be in turn supported by the fin support assembly 102. Further, the fin axle 116 may be rotatably supported by one or more bearings 512, which in turn may be supported by the fin support assembly 102. A snap ring 514 may be used to retain the worm gear 508 and the bearings 512 in the fin support assembly 102. The assembled worm gear assembly 500 is shown in FIG. 6.

Figure 7:
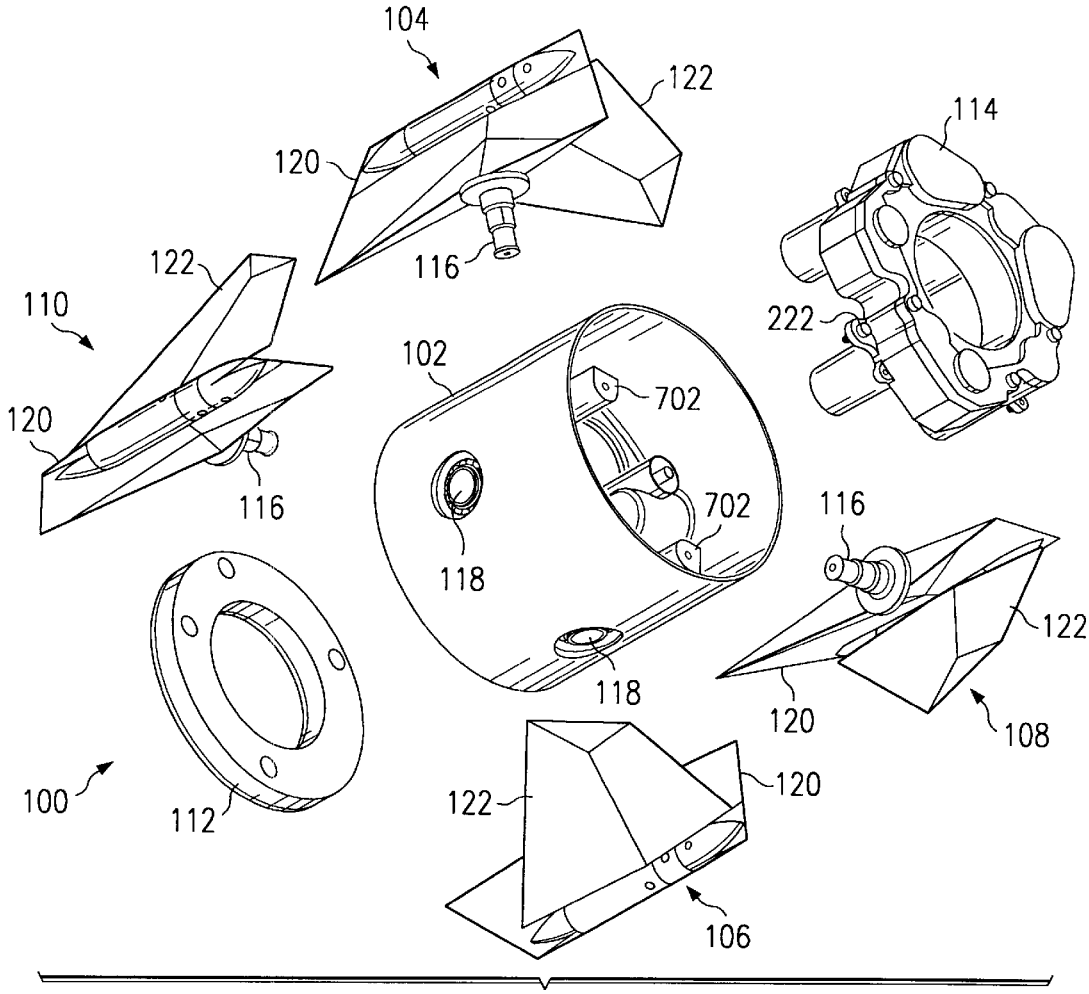
FIG. 7 is an exploded perspective view of the flight control system of FIG. 1 shown from an alternative viewpoint.

In one embodiment, the drive assembly 114 is mounted to the fin support assembly 102 by a plurality of compliant fasteners 222 (only one shown), as illustrated in FIG. 7. The compliant fasteners 222 reduce the likelihood that the drive assembly 114 would be loaded and/or deformed in the event the fin support assembly 102 is deformed. The compliant fasteners 222, as illustrated in FIG. 2, may include a hollow cylinder 224 made of an elastomeric material (e.g., a natural rubber, a synthetic rubber, or the like) and a fastener 226 (e.g., a machine screw, a bolt, or the like) extending through the hollow cylinder. In the illustrated embodiment, each of the fasteners 226 is engaged with a threaded opening 702 (only two shown).

Figure 8:
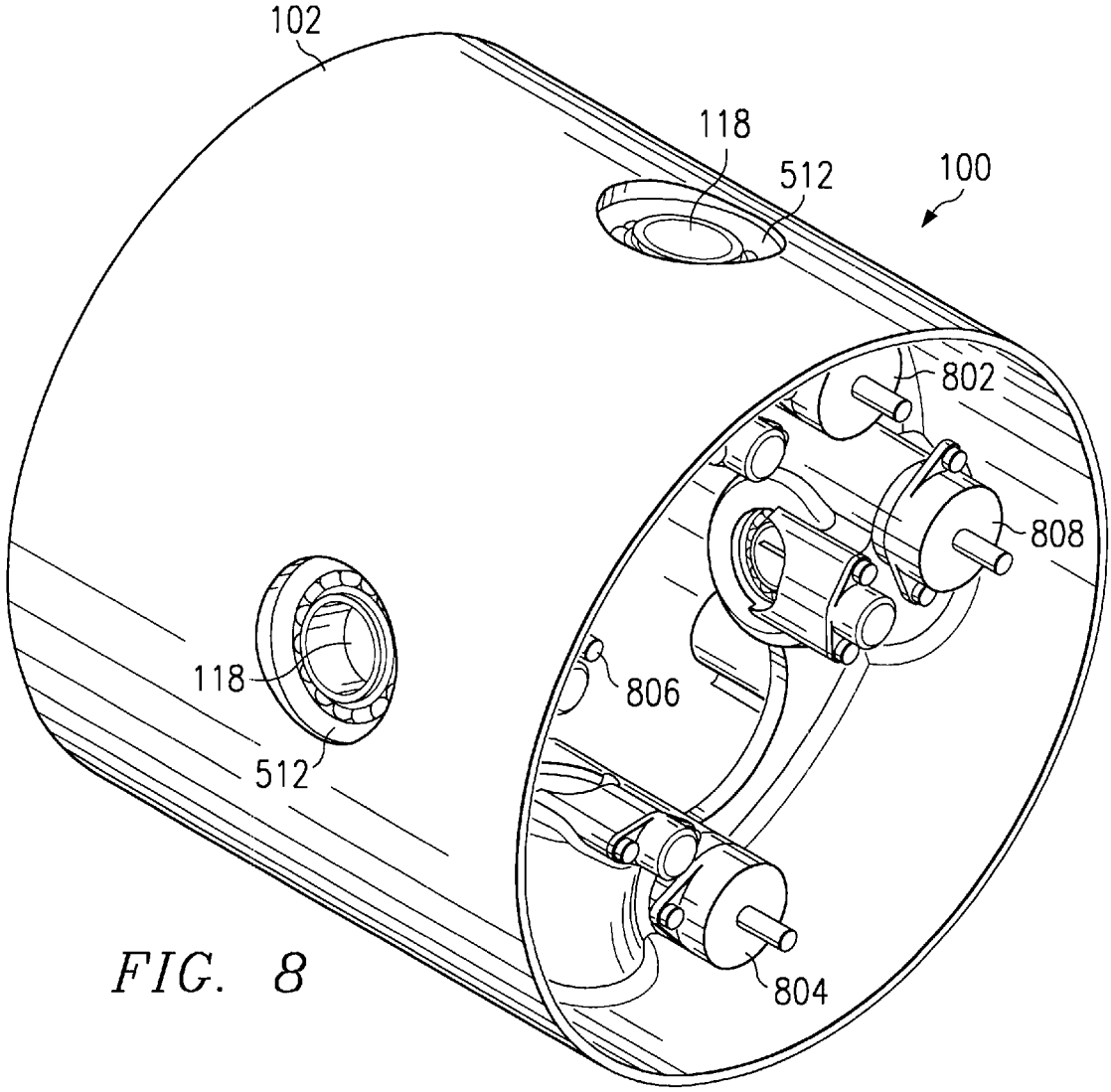
FIG. 8 is a perspective view of the fin support assembly illustrated in FIGS. 1 and 7.

It is desirable for the attitude of each of the fin assemblies 104, 106, 108, 110 to be made available to the trajectory controller (not shown) so that appropriate changes to the attitudes of the fin assemblies 104, 106, 108, 110 may be calculated for a change in trajectory. As illustrated in FIG. 8, a plurality of position sensors 802, 804, 806, 808 are mounted within the fin support assembly 102 to sense the position of each of the fin assemblies 104, 106, 108, 110, respectively. In the illustrated embodiment, one of the position sensors 802, 804, 806, 808 is mechanically coupled with a second end 516 (shown in FIG. 5) of the worm shaft 504 so that the position of the fin assembly 104, 106, 108, 110 that is being driven by the worm shaft 504 may be known absent positioning errors induced by gearing clearances, manufacturing tolerances, and the like within the planetary drive train 210. Alternatively, the position sensors 802, 804, 806, 808 may be coupled directly to the planetary drive train 210. Further, the fin position sensors 802, 804, 806, 808 may be instead coupled directly to the fin axle 116.

Figure 9:
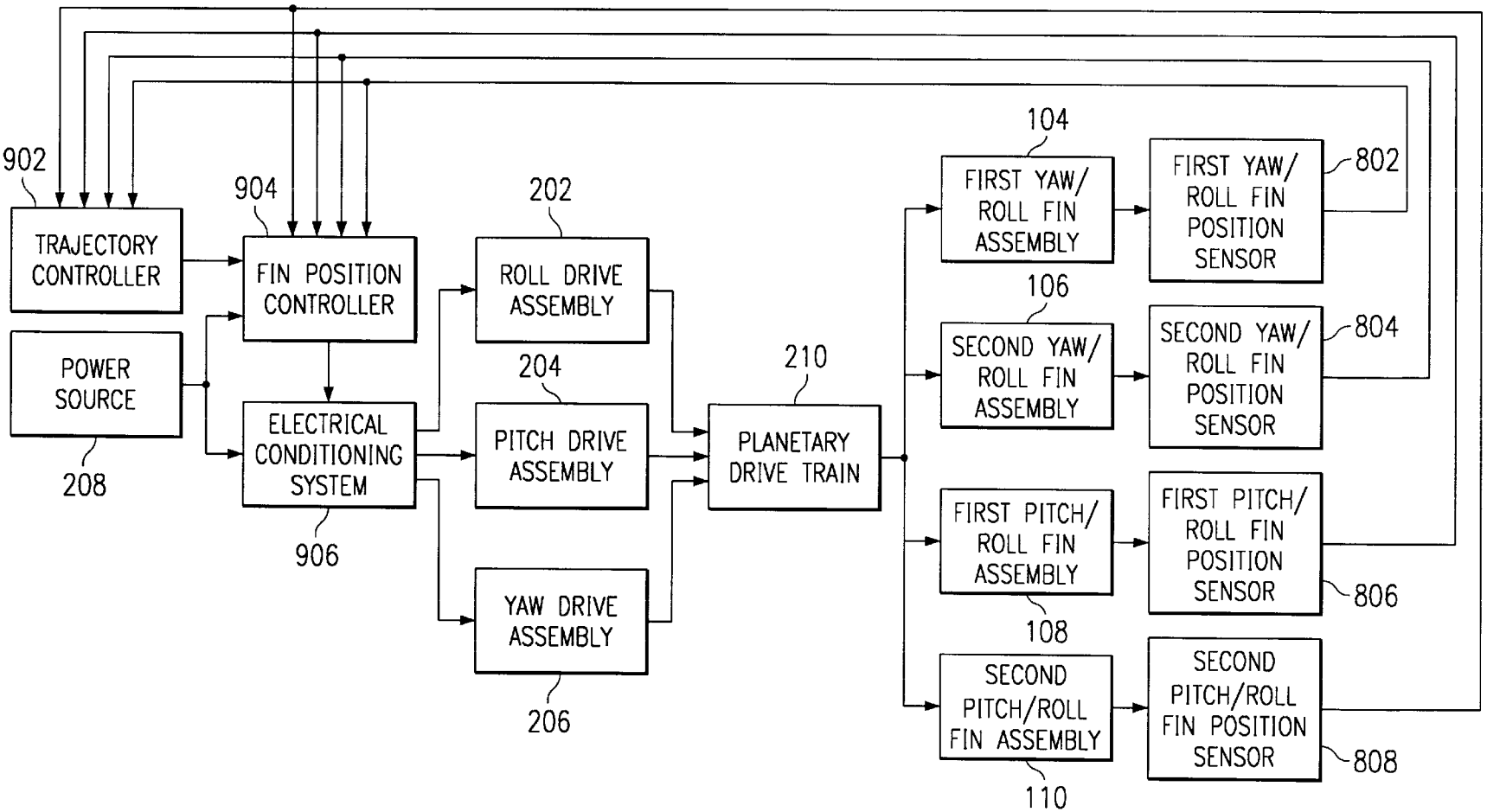
FIG. 9 is a block diagram of an flight control system according to the present invention.

FIG. 9 illustrates an operation of the flight control system 100. Generally, a trajectory controller 902 calculates aerodynamic attitudes of the fin assemblies 104, 106, 108, 110 to control the roll, pitch, and yaw of the projectile 101 so that the projectile 101 may strike the target. The fin assembly attitudes may be calculated based upon a predetermined flight path for the projectile 101, in response to one or more changing flight conditions, and/or based upon a predetermined location of the target.

In the illustrated embodiment, electrical signals corresponding to the desired projectile trajectory or fin assembly attitudes are transmitted from the trajectory controller 902 to the roll drive assembly 202, the yaw drive assembly 206 and/or the pitch drive assembly 204 via a fin position controller 904 and an electrical conditioning system 906. The fin position controller 904 may, in one embodiment, transform the trajectory signals, sent from the trajectory controller 902, into the desired fin assembly attitudes. Alternatively, the fin position controller 904 may control the fin assemblies 104, 106, 108, 110 based on the fin assembly attitudes sent from the trajectory controller 902. The electrical conditioning system 906 may convert electrical power provided by the power source 208 into forms that can be used to power the roll drive assembly 202, the yaw drive assembly 204, the pitch drive assembly 206, and the like upon instruction from the fin position controller 904. The electrical conditioning system 906 may also convert other electrical signals transmitted by various components within the flight control system 100 so that they may be used by other components of the flight control system 100. The present invention, however, also encompasses a flight control system that omits the electrical conditioning system 906.

As described previously, the drive assemblies 202, 204, 206 drive the planetary drive train 210 which, in turn, move the fin assemblies 104, 106, 108, 110. The position sensors 802, 804, 806, 808 sense the positions of the fin assemblies 104, 106, 108, 110 and feed the information back to the trajectory controller 902 and/or the fin position controller 904.

Figure 10:
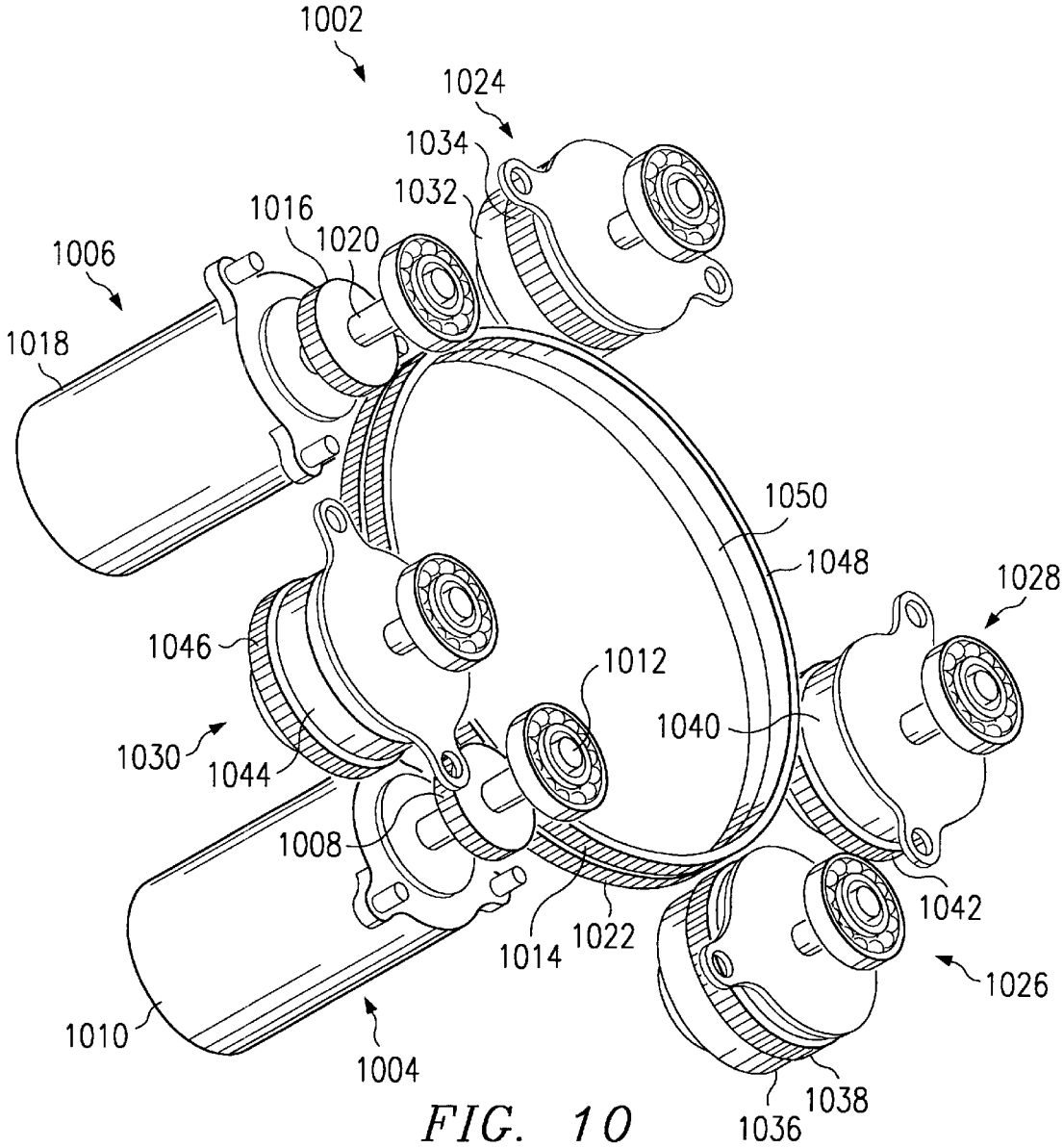
FIG. 10 is a perspective view of an alternative planetary drive train according to the present invention.

In one embodiment of the present invention, only the pitch and yaw of the projectile 101 is controlled by the flight control system 100. FIG. 10 illustrates a planetary drive train 1002, which replaces the planetary drive train 210 and was first shown in FIG. 2. Also illustrated in FIG. 10 is a yaw drive assembly 1004 and a pitch drive assembly 1006, which correspond to the yaw drive assembly 204 and the pitch drive assembly 206, respectively, which were also first shown in FIG. 2. Other elements of this embodiment correspond to the elements of the previous embodiment as described above and shown in FIGS. 1–8.

Still referring to FIG. 10, the yaw drive assembly 1004 includes a yaw drive gear 1008, which is connected to a yaw drive motor 1010 by a yaw drive shaft 1012. The yaw drive gear 1008 is engaged with a yaw ring gear 1014 such that, as the yaw drive motor 1010 rotates the yaw drive shaft 1012, the yaw ring gear 1014 is rotated. Similarly, the pitch drive assembly 1006 includes a pitch drive gear 1016, which is connected to a pitch drive motor 1018 by a pitch drive shaft 1020. The pitch drive gear 1016 is engaged with a pitch ring gear 1022 such that, as the pitch drive motor 1018 rotates the pitch drive shaft 1020, the pitch ring gear 1022 is rotated.

The planetary drive train 1002 also includes a first yaw gear set 1024, a second yaw gear set 1026, a first pitch gear set 1028, and a second pitch gear set 1030. Each of the gear sets 1024, 1026, 1028, 1030 are coupled with one of the fin assemblies 104, 106, 108, 110, as described previously with regard to the gear sets 326, 328, 330, 332. The first yaw gear set 1024 includes a yaw gear 1032 having an external gear 1034 engaged with the yaw ring gear 1014. Further, the second yaw gear set 1026 includes a yaw gear 1036 having an external gear 1038 engaged with the yaw ring gear 1014. Thus, as the yaw ring gear 1014 is rotated by the yaw drive gear 1008, the yaw gear 1032 of the first yaw gear set 1024 and the yaw gear 1036 of the second yaw gear set 1026 are rotated.

Still referring to FIG. 10, the first pitch gear set 1028 includes a pitch gear 1040 having an external gear 1042 engaged with the pitch ring gear 1022. Further, the second pitch gear set 1030 includes a pitch gear 1044 having an external gear 1046 engaged with the pitch ring gear 1022. Thus, as the pitch ring gear 1022 is rotated by the pitch drive gear 1016, the pitch gear 1040 of the first pitch gear set 1028 and the pitch gear 1044 of the second pitch gear set 1030 are rotated. Each of the yaw ring gear 1014 and the pitch ring gear 1022 are rotatably mounted to the flange 220 (shown in FIG. 2) of the gearbox 212 via a bearing 1048, 1050, respectively.

Thus, the planetary drive train 1002 generally corresponds to the planetary drive train 210 (first shown in FIG. 2) except that components that are used to control the roll of the projectile 101 have been omitted.

Alternatively, a flight control system according to the present invention may include one or more ring gear/torque motor assemblies in lieu of one or more of the ring gears 302, 304, 306 (shown in FIG. 3) and correspondingly one or more drive assemblies 202, 204, 206 (shown in FIG. 2). Other aspects of this embodiment of the present invention correspond to those described previously and illustrated in FIGS. 1–8.

Figure 11:
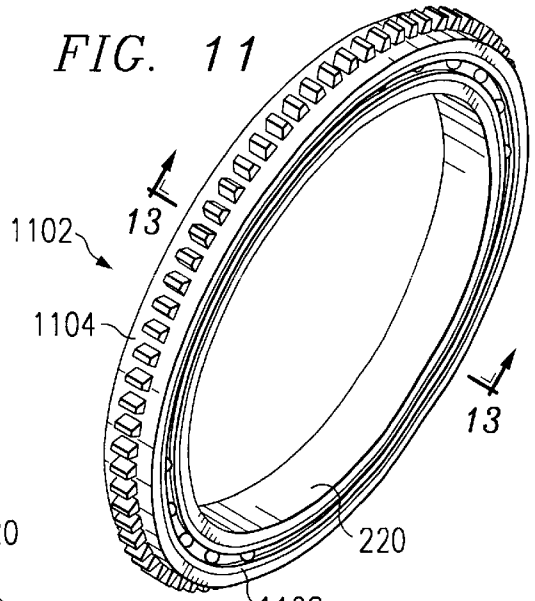
FIG. 11 is a perspective view of a ring gear/torque motor assembly according to the present invention.
Figure 12:
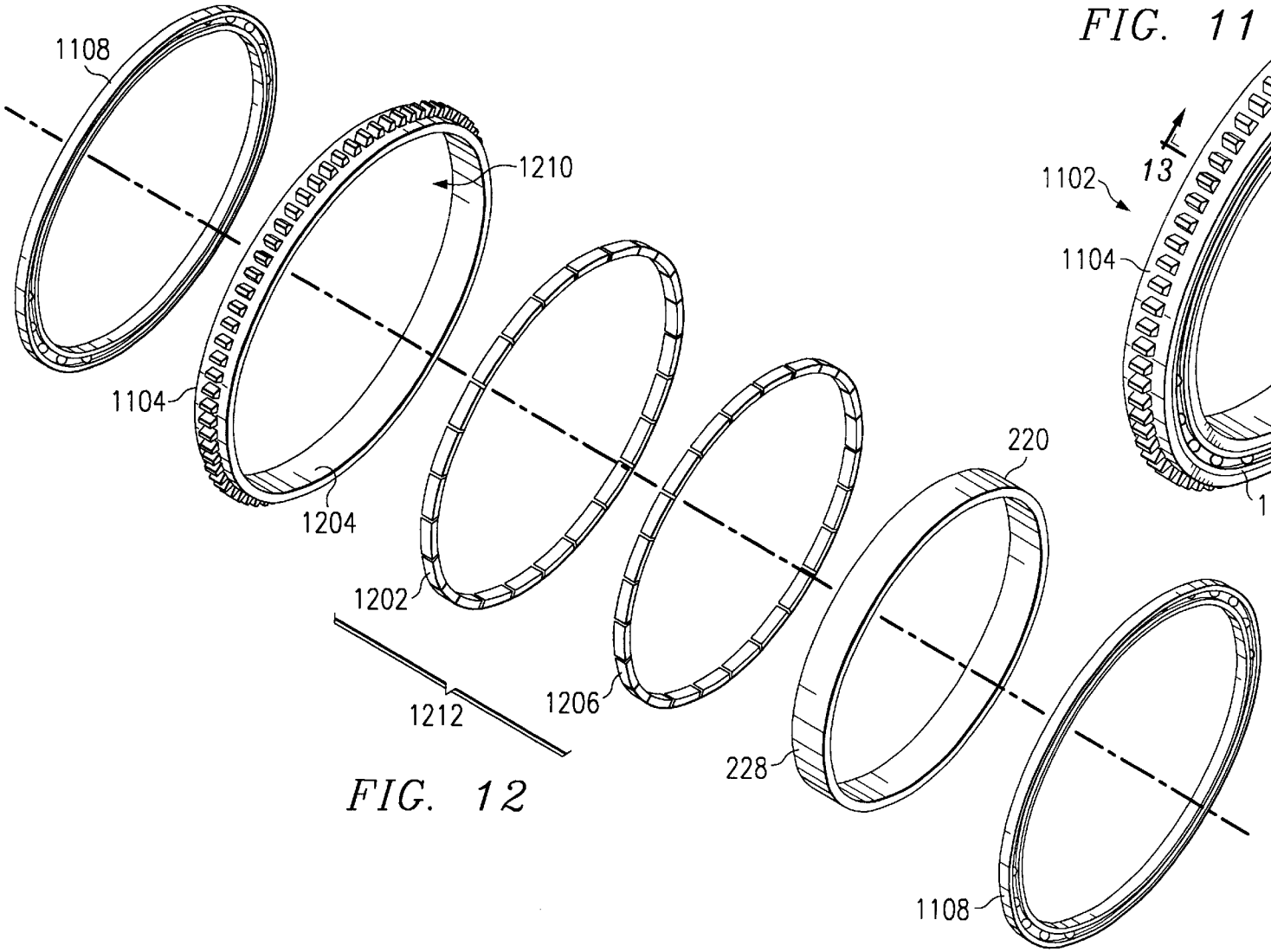
FIG. 12 is an exploded view of the ring gear/torque motor assembly of FIG. 11.
Figure 13:
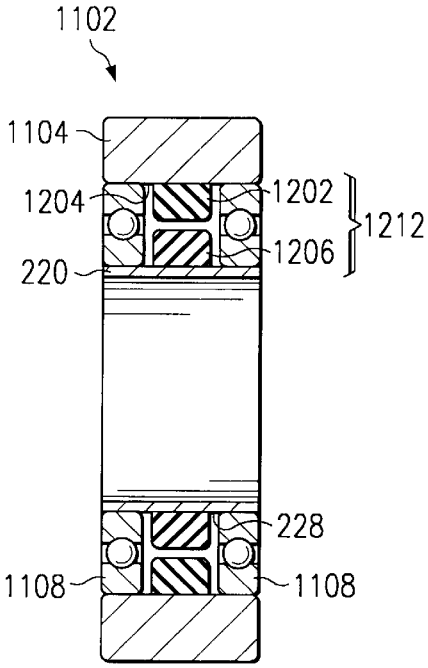
FIG. 13 is a cross-sectional view of the ring gear/torque motor assembly of FIG. 11 taken along the 13—13 line.

In the embodiment illustrated in FIGS. 11–13, a ring gear/torque motor assembly 1102 includes a plurality of magnets 1202 attached to an inner surface 1204 of a ring gear 1104. Further, the ring gear/torque motor assembly 1102 further includes a plurality of stator coils 1206 attached to an outer surface 228 of the flange 220 (shown in FIG. 2 and shown in part in FIGS. 11–13). Alternatively, the plurality of magnets 1202 may be embedded in the ring gear 1104 and/or the plurality of stator coils may be embedded in the flange 220. In the illustrated embodiment, the ring gear 1104 is rotatably mounted to the flange 220 by a pair of bearings 1108.

The plurality of magnets 1202 in combination with the plurality of stator coils 1206 form a torque motor 1212 for rotating the ring gear 1104 with respect to the flange 220. By applying an electrical current to the plurality of stator coils 1206, a magnetic field is established that interacts with the plurality of magnets 1202, causing the ring gear 1104 to rotate with respect to the flange 220. Thus, by controlling the application of the electrical current to the stator coils 1206, the rotation of the ring gear 1104 with respect to the flange 220 may be controlled in the same way the drive assemblies 202, 204, 206 are used to control the rotation of each of the ring gears 302, 304, 306, respectively, as illustrated in FIG. 3.

A flight control assembly employing one or more torque motors 1212 may operate in the same fashion as the flight control assembly 100 illustrated in FIG. 9. In such a flight control assembly, one or more of the drive assemblies 202, 204, 206, shown in FIG. 9, are replaced by a commensurate number of torque motors 1212.

Figure 14:
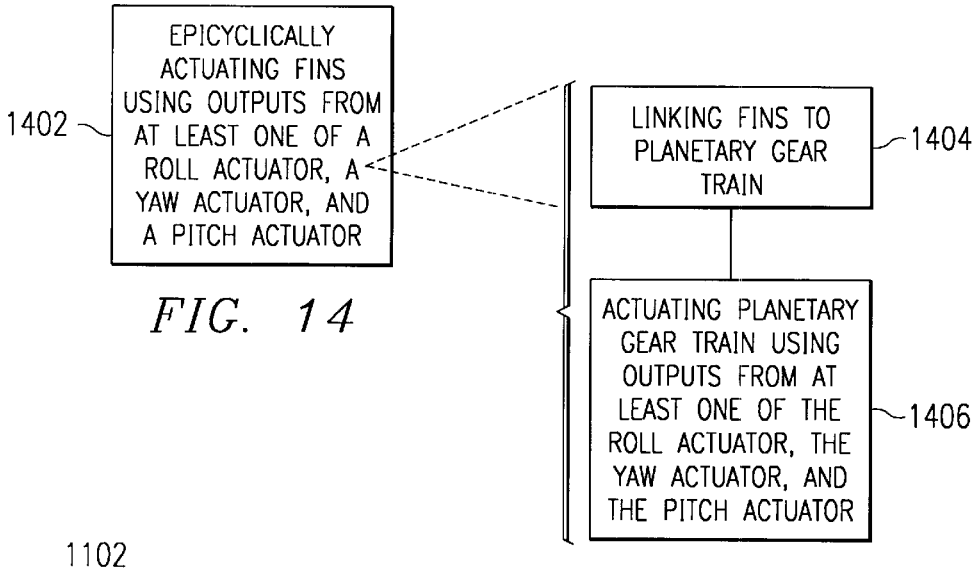
FIG. 14 is a flowchart of a method according to an embodiment of the present invention.

As illustrated in FIG. 14, the present invention includes a method comprising epicyclically actuating a plurality of fins using outputs from at least one of a roll actuator, a yaw actuator, and a pitch actuator, e.g., the drive assemblies 202, 204, 206, 1004, 1006, or the like (block 1402). In the illustrated embodiment, actuating the plurality of fins further comprises linking the plurality fins to a planetary gear train (block 1404) and actuating the planetary gear train using the outputs from at least one of the roll actuator, the yaw actuator, and the pitch actuator (block 1406). It may be desirable to actuate the fins to control only yaw and pitch. Thus, in this embodiment, the fins would be epicyclically actuated using outputs from at least one of the yaw actuator and the pitch actuator and the planetary gear train would be actuated using outputs from at least one of the yaw actuator and pitch actuator.

Figure 15:
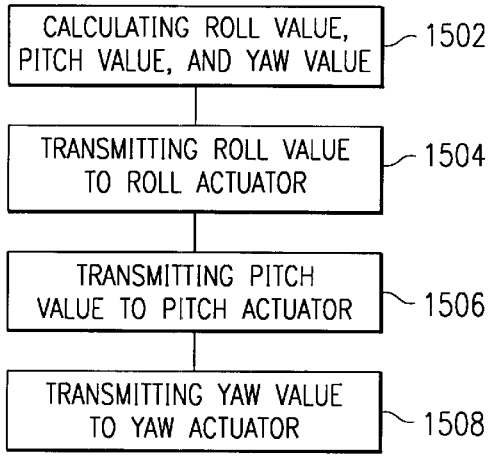
FIG. 15 is a flow chart of a method according to an embodiment of the present invention.

In another embodiment, the method further includes calculating a roll value, a pitch value, and a yaw value corresponding to the trajectory (block 1502), transmitting the roll value to the roll actuator (block 1504), transmitting the pitch value to the pitch actuator (block 1506), and transmitting the yaw value to the yaw actuator (block 1508), as illustrated in FIG. 15. Alternatively, if only yaw and pitch are to be controlled, only the pitch value and the yaw value would be calculated and transmitted to the pitch actuator and the yaw actuator, respectively.

Figure 16:
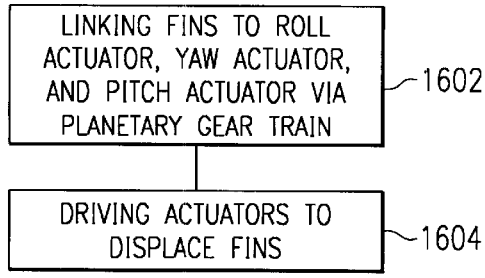
FIG. 16 is a flow chart of a method according to an embodiment of the present invention.

According to another embodiment of the present invention illustrated in FIG. 16, a method comprises linking a plurality of fins to a roll actuator, a yaw actuator, and a pitch actuator via a planetary gear train (block 1602) and driving the roll actuator, the yaw actuator, and the pitch actuator to displace the plurality of fins (block 1604). In one embodiment illustrated in FIG. 15, the method further includes calculating a roll value, a pitch value, and a yaw value corresponding to the trajectory (block 1502), transmitting the roll value to the roll actuator (block 1504), transmitting the pitch value to the pitch actuator (block 1506), and transmitting the yaw value to the yaw actuator (block 1508). However, if only yaw and pitch are to be controlled, the present invention encompasses linking the plurality of fins to a yaw actuator and a pitch actuator via a planetary gear train and driving the yaw actuator and the pitch actuator to displace the plurality of fins. In such an embodiment, only the pitch value and the yaw value would be calculated and transmitted to the pitch actuator and the yaw actuator, respectively.

While the present invention has been described relating to the control of four fin assemblies 104, 106, 108, 110, the present invention encompasses the control of any number of fin assemblies (e.g., the fin assemblies 104, 106, 108, 110). Thus, embodiments alternative to that shown herein may employ less than four fin assemblies or more than four fin assemblies. Further, the present invention may be used to control any combination of roll, pitch, and yaw. For example, the present invention may control roll, pitch, and yaw; roll and pitch; roll and yaw; pitch and yaw; roll; pitch; or yaw. If in various embodiments, control of one or more of roll, pitch, and yaw are omitted, elements corresponding to the omitted roll, pitch, and/or yaw may be also omitted from the present invention.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus for controlling a trajectory of a projectile, comprising:

a planetary drive train;

a yaw drive assembly engaged with the planetary drive train;

a pitch drive assembly engaged with the planetary drive train; and a plurality of fin assemblies linked with the planetary drive train such that, as the planetary drive train is actuated by at least one of the yaw drive assembly and the pitch drive assembly, corresponding displacements are produced in the plurality of fin assemblies.

2. An apparatus, according to claim 1, wherein the plurality of fin assemblies further comprises four fin assemblies.

3. An apparatus, according to claim 1, wherein at least one of the yaw drive assembly and the pitch drive assembly further comprises:

a motor having a shaft extending therefrom being rotatable upon actuation of the motor; and a gear mounted to the shaft.

4. An apparatus, according to claim 1, wherein at least one of the yaw drive assembly and the pitch drive assembly further comprises a torque motor.

5. An apparatus, according to claim 1, wherein the planetary drive train further comprises:

a yaw ring gear engaged with the yaw drive assembly;

a pitch ring gear engaged with the pitch drive assembly;

a first yaw gear set engaged with the yaw ring gear and linked with a first one of the plurality of fin assemblies;

a second yaw gear set engaged with the yaw ring gear and linked with a second one of the plurality of fin assemblies;

a first pitch gear set engaged with the pitch ring gear and linked with a third one of the plurality of fin assemblies; and a second pitch gear set engaged with the pitch ring gear and linked with a fourth one of the plurality of fin assemblies.

6. An apparatus, according to claim 5, wherein each of the first yaw gear set and the second yaw gear set further comprises:

a shaft;

a yaw gear having an external gear and an internal gear, wherein the external gear is engaged with the yaw ring gear;

a planet carrier linked to one of the first one of the plurality of fin assemblies and the second one of the plurality of fin assemblies;

a plurality of planet gears rotatably mounted to the planet carrier and engaged with the internal gear of the yaw gear; and a sun gear engaged with each of the plurality of planet gears and mounted to the shaft.

7. An apparatus, according to claim 5, wherein each of the first pitch gear set and the second pitch gear set further comprises:

a shaft;

a pitch gear having an external gear and an internal gear, wherein the external gear is engaged with the pitch ring gear;

a planet carrier linked to one of the third one of the plurality of fin assemblies and the fourth one of the plurality of fin assemblies;

a plurality of planet gears rotatably mounted to the planet carrier and engaged with the internal gear of the pitch gear; and a sun gear engaged with each of the plurality of planet gears and mounted to the shaft.

8. An apparatus, according to claim 5, wherein each of the plurality of fin assemblies is linked with the planetary drive by a worm gear assembly, comprising:

a worm shaft having a worm;

a drive link coupled with one of the plurality of fin assemblies and mounted to an end of the worm shaft; and a worm gear engaged with the worm and the one of the fin assemblies.

9. An apparatus, according to claim 5, wherein each of the plurality of fin assemblies further comprises a fin axle being linked with the planetary drive by a worm gear assembly, comprising:

a worm shaft having a worm;

a drive link coupled with one of the plurality of fin assemblies and mounted to an end of the worm shaft; and a worm gear engaged with the worm and the fin axle.

10. An apparatus, according to claim 1, further comprising:

a power source capable of outputting electrical power;

a trajectory controller capable of outputting signals to drive each of the yaw drive assembly and the pitch drive assembly and being electrically interconnected with the power source, the yaw drive assembly, and the pitch drive assembly; and a plurality of position sensors electrically interconnected with the power source and the trajectory controller, wherein each of the position sensors is capable of sensing a position of one of the plurality of fin assemblies and outputting the position to the trajectory controller.

11. An apparatus, according to claim 1, further comprising:

a power source capable of outputting electrical power;

a trajectory controller capable of determining a trajectory of the projectile;

a fin position controller capable of outputting signals to drive each of the yaw drive assembly and the pitch drive assembly based upon the trajectory of the projectile and being electrically interconnected with the power source, the trajectory controller, the yaw drive assembly, and the pitch drive assembly; and a plurality of position sensors electrically interconnected with the power source, the trajectory controller, and the fin position controller, wherein each of the position sensors is capable of sensing a position of one of the plurality of fin assemblies and outputting the position to the trajectory controller and the fin position controller.

12. An apparatus, according to claim 11, further comprising an electrical conditioning system electrically interconnected with at least one of the power source, the trajectory controller, and the plurality of position sensors and being capable of conditioning electrical signals transmitted therebetween.

13. An apparatus, according to claim 1, further comprising:

a gearbox defining a cavity therein; and a gearbox cover enclosing the gearbox cavity, wherein the planetary drive train is disposed within the gearbox cavity.

14. An apparatus, according to claim 13, wherein each of the yaw drive assembly and the pitch drive assembly are mounted to the gearbox.

15. An apparatus, according to claim 1, further comprising a fin support assembly defining a cavity therein and having an outer wall defining a plurality of openings therethrough, wherein the planetary drive train, the yaw drive assembly, and the pitch drive assembly are disposed within the cavity, and wherein each of the plurality of fin assemblies extends through the one of the plurality of openings though the outer wall.

16. An apparatus according to claim 1, further comprising:

a fin support assembly defining a cavity therein and having an outer wall defining a plurality of openings therethrough;

a gearbox defining a cavity therein, wherein the planetary drive train is disposed within the gearbox cavity; and a gearbox cover enclosing the gearbox cavity, wherein the gearbox is disposed within the cavity of the fin support assembly and attached to the fin support assembly.

17. An apparatus for controlling a trajectory of a projectile, comprising:

a planetary drive train;

a roll drive assembly engaged with the planetary drive train;

at least one of a yaw drive assembly engaged with the planetary drive train and a pitch drive assembly engaged with the planetary drive train; and a plurality of fin assemblies linked with the planetary drive train such that, as the planetary drive train is actuated by at least one of the roll drive assembly, the yaw drive assembly, and the pitch drive assembly, corresponding displacements are produced in the plurality of fin assemblies.

18. An apparatus, according to claim 17, wherein at least one of the roll drive assembly, the yaw drive assembly, and the pitch drive assembly further comprises:

a motor having a shaft extending therefrom being rotatable upon actuation of the motor; and a gear mounted to the shaft.

19. An apparatus, according to claim 17, wherein at least one of the roll drive assembly, the yaw drive assembly, and the pitch drive assembly further comprises a torque motor.

20. An apparatus, according to claim 17, wherein the planetary drive train further comprises:

a roll ring gear engaged with the roll drive assembly;

a yaw ring gear engaged with the yaw drive assembly;

a pitch ring gear engaged with the pitch drive assembly;

a first yaw/roll gear set engaged with the roll ring gear and the yaw ring gear and linked with a first one of the plurality of fin assemblies;

a second yaw/roll gear set engaged with the yaw ring gear and linked with the roll ring gear and a second one of the plurality of fin assemblies;

a first pitch/roll gear set engaged with the roll ring gear and the yaw ring gear and linked with a third one of the plurality of fin assemblies; and a second pitch/roll gear set engaged with the pitch ring gear and linked with the roll ring gear and a fourth one of the plurality of fin assemblies.

21. An apparatus, according to claim 17, wherein:

the plurality of fin assemblies further comprises a first yaw/roll fin assembly, a second yaw/roll fin assembly, a first pitch/roll fin assembly, and a second pitch/roll fin assembly; and the planetary drive train further comprises:

a roll ring gear engaged with the roll drive assembly;

a yaw ring gear engaged with the yaw drive assembly;

a pitch ring gear engaged with the pitch drive assembly;

a first roll reversing idler engaged with the roll ring gear;

a second roll reversing idler engaged with the roll ring gear;

a first yaw/roll gear set engaged with the roll ring gear and the yaw ring gear and linked with the first yaw/roll fin assembly;

a second yaw/roll gear set engaged with the first roll reversing idler and the yaw ring gear and linked with the second yaw/roll fin assembly;

a first pitch/roll gear set engaged with the roll ring gear and the yaw ring gear and linked with the first pitch/roll fin assembly; and a second pitch/roll gear set engaged with the second roll reversing idler and the pitch ring gear and linked with the second pitch/roll fin assembly.

22. An apparatus, according to claim 21, wherein the first yaw/roll gear set further comprises:

a shaft;

a roll gear engaged with the roll ring gear and mounted to the shaft;

a yaw gear having an external gear and an internal gear, wherein the external gear is engaged with the yaw ring gear;

a planet carrier linked to the first yaw/roll fin assembly;

a plurality of planet gears rotatably mounted to the planet carrier and engaged with the internal gear of the yaw gear; and a sun gear engaged with each of the plurality of planet gears and mounted to the shaft.

23. An apparatus, according to claim 21, wherein the second yaw/roll gear set further comprises:

a shaft;

a roll gear engaged with the first roll reversing idler and mounted to the shaft;

a yaw gear having an external gear and an internal gear, wherein the external gear is engaged with the yaw ring gear;

a planet carrier linked to the second yaw/roll fin assembly;

a plurality of planet gears rotatably mounted to the planet carrier and engaged with the internal gear of the yaw gear; and a sun gear engaged with each of the plurality of planet gears and mounted to the shaft.

24. An apparatus, according to claim 21, wherein the first pitch/roll gear set further comprises:

a shaft;

a roll gear engaged with the roll ring gear and mounted to the shaft;

a pitch gear having an external gear and an internal gear, wherein the external gear is engaged with the pitch ring gear;

a planet carrier linked to the first pitch/roll fin assembly;

a plurality of planet gears rotatably mounted to the planet carrier and engaged with the internal gear of the pitch gear; and a sun gear engaged with each of the plurality of planet gears and mounted to the shaft.

25. An apparatus, according to claim 21, wherein the second pitch/roll gear set further comprises:

a shaft;

a roll gear engaged with the second roll reversing idler and mounted to the shaft;

a pitch gear having an external gear and an internal gear, wherein the external gear is engaged with the pitch ring gear;

a planet carrier linked to the second pitch/roll fin assembly;

a plurality of planet gears rotatably mounted to the planet carrier and engaged with the internal gear of the yaw gear; and a sun gear engaged with each of the plurality of planet gears and mounted to the shaft.

26. An apparatus, according to claim 21, wherein the first roll reversing idler further comprises:

a shaft;

a first gear mounted to the shaft and engaged with the roll ring gear; and a second gear mounted to the shaft and engaged with the second yaw/roll gear set.

27. An apparatus, according to claim 21, wherein the second roll reversing idler further comprises:

a shaft;

a first gear mounted to the shaft and engaged with the roll ring gear; and a second gear mounted to the shaft and engaged with the second pitch/roll gear set.

28. An apparatus, according to claim 21, wherein each of the plurality of fin assemblies is linked with the planetary drive by a worm gear assembly, comprising:

a worm shaft having a worm;

a drive link coupled with one of the plurality of fin assemblies and mounted to an end of the worm shaft; and a worm gear engaged with the worm and the one of the fin assemblies.

29. An apparatus, according to claim 21, wherein each of the plurality of fin assemblies further comprises a fin axle being linked with the planetary drive by a worm gear assembly, comprising:

a worm shaft having a worm;

a drive link coupled with one of the plurality of fin assemblies and mounted to an end of the worm shaft; and a worm gear engaged with the worm and the fin axle.

30. An apparatus, according to claim 17, further comprising:

a power source capable of outputting electrical power;

a trajectory controller capable of outputting signals to drive each of the roll drive assembly, the yaw drive assembly, and the pitch drive assembly and being electrically interconnected with the power source, the roll drive assembly, the yaw drive assembly, and the pitch drive assembly; and a plurality of position sensors electrically interconnected with the power source and the trajectory controller, wherein each of the position sensors is capable of sensing a position of one of the plurality of fin assemblies and outputting the position to the trajectory controller.

31. An apparatus, according to claim 17, further comprising:

a power source capable of outputting electrical power;

a trajectory controller capable of determining a trajectory of the projectile;

a fin position controller capable of outputting signals to drive each of the roll drive assembly, the yaw drive assembly, and the pitch drive assembly based upon the trajectory of the projectile and being electrically interconnected with the power source, the trajectory controller, the roll drive assembly, the yaw drive assembly, and the pitch drive assembly; and a plurality of position sensors electrically interconnected with the power source, the trajectory controller, and the fin position controller, wherein each of the position sensors is capable of sensing a position of one of the plurality of fin assemblies and outputting the position to the trajectory controller and the fin position controller.

32. An apparatus, according to claim 31, further comprising an electrical conditioning system electrically interconnected with at least one of the power source, the trajectory controller, and the plurality of position sensors and being capable of conditioning electrical signals transmitted therebetween.

33. An apparatus, according to claim 17, further comprising:

a gearbox defining a cavity therein; and a gearbox cover enclosing the gearbox cavity, wherein the planetary drive train is disposed within the gearbox cavity.

34. An apparatus, according to claim 17, wherein each of the roll drive assembly, the yaw drive assembly, and the pitch drive assembly are mounted to the gearbox.

35. An apparatus, according to claim 17, further comprising a fin support assembly defining a cavity therein and having an outer wall defining a plurality of openings therethrough, wherein the planetary drive train, the roll drive assembly, the yaw drive assembly, and the pitch drive assembly are disposed within the cavity, and wherein each of the plurality of fin assemblies extends through the one of the plurality of openings though the outer wall.

36. An apparatus according to claim 17, further comprising:

a fin support assembly defining a cavity therein and having an outer wall defining a plurality of openings therethrough;

a gearbox defining a cavity therein, wherein the planetary drive train is disposed within the gearbox cavity; and a gearbox cover enclosing the gearbox cavity, wherein the gearbox is disposed within the cavity of the fin support assembly and attached to the fin support assembly.

37. A method for controlling a trajectory of a projectile, comprising epicyclically actuating a plurality of fins using outputs from at least one of a roll actuator, a yaw actuator, and a pitch actuator.

38. A method, according to claim 37, wherein epicyclically actuating the plurality of fins further comprises:

linking the plurality of fins to a planetary gear train; and actuating the planetary gear train using the outputs from at least one of the roll actuator, the yaw actuator, and the pitch actuator.

39. A method, according to claim 37, further comprising:

calculating a pitch value and a yaw value corresponding to the trajectory;

transmitting the yaw value to the yaw actuator; and transmitting the pitch value to the pitch actuator.

40. A method, according to claim 37, further comprising:

calculating a roll value, a pitch value, and a yaw value corresponding to the trajectory;

transmitting the roll value to the roll actuator;

transmitting the yaw value to the yaw actuator; and transmitting the pitch value to the pitch actuator.

41. A method for controlling a trajectory of a projectile, comprising:

linking a plurality of fins to a yaw actuator and a pitch actuator via a planetary gear train; and driving the yaw actuator and the pitch actuator to displace the plurality of fins.

42. A method, according to claim 41, further comprising:

calculating a pitch value and a yaw value corresponding to the trajectory;

transmitting the yaw value to the yaw actuator; and transmitting the pitch value to the pitch actuator.

43. A method, according to claim 41, further comprising:

linking a plurality of fins to a roll actuator; and driving the roll actuator to displace the plurality of fins.

44. A method, according to claim 41, further comprising:

calculating a roll value, a pitch value, and a yaw value corresponding to the trajectory;

transmitting the roll value to the roll actuator;

transmitting the yaw value to the yaw actuator; and transmitting the pitch value to the pitch actuator.

45. An apparatus for controlling a trajectory of a projectile, comprising means for epicyclically actuating a plurality of fins using outputs from at least one of a roll actuator, a yaw actuator, and a pitch actuator.

46. An apparatus, according to claim 45, wherein the means for epicyclically actuating the plurality of fins further comprises:

means for linking the plurality of fins to a planetary gear train; and means for actuating the planetary gear train using the outputs from at least one of the roll actuator, the yaw actuator, and the pitch actuator.

47. An apparatus, according to claim 45, further comprising:

means for calculating a pitch value and a yaw value corresponding to the trajectory;

means for transmitting the yaw value to the yaw actuator; and means for transmitting the pitch value to the pitch actuator.

48. An apparatus, according to claim 45, further comprising:

means for calculating a roll value, a pitch value, and a yaw value corresponding to the trajectory;

means for transmitting the roll value to the roll actuator;

means for transmitting the yaw value to the yaw actuator; and means for transmitting the pitch value to the pitch actuator.

49. An apparatus for controlling a trajectory of a projectile, comprising:

means for linking a plurality of fins to a yaw actuator and a pitch actuator via a planetary gear train; and means for driving the yaw actuator and the pitch actuator to displace the plurality of fins.

50. An apparatus, according to claim 49, further comprising:

means for calculating a pitch value and a yaw value corresponding to the trajectory;

means for transmitting the yaw value to the yaw actuator; and means for transmitting the pitch value to the pitch actuator.

51. An apparatus, according to claim 49, further comprising:

means for linking a plurality of fins to a roll actuator; and means for driving the roll actuator to displace the plurality of fins.

52. An apparatus, according to claim 49, further comprising:

means for calculating a roll value, a pitch value, and a yaw value corresponding to the trajectory;

means for transmitting the roll value to the roll actuator;

means for transmitting the yaw value to the yaw actuator; and means for transmitting the pitch value to the pitch actuator.

53. A projectile, comprising:

a flight control system disposed within the fuselage, wherein the flight control system comprises:

a planetary drive train;

a yaw drive assembly engaged with the planetary drive train;

a pitch drive assembly engaged with the planetary drive train; and a plurality of fin assemblies extending through the fuselage and linked with the planetary drive train such that, as the planetary drive train is actuated by at least one of the yaw drive assembly and the pitch drive assembly, corresponding displacements are produced in the plurality of fin assemblies.

54. A projectile, according to claim 53, further comprising a roll drive assembly engaged with the planetary drive train, wherein as the planetary drive train is actuated by at least one of the roll drive assembly, the yaw drive assembly, and the pitch drive assembly, corresponding displacements are produced in the plurality of fin assemblies.

55. An apparatus for controlling a trajectory of a projectile, comprising:

means for steering the projectile;

means for producing a mechanical output corresponding to a yaw and a pitch of the trajectory; and means for epicyclically linking the means for producing the mechanical output and the means for steering the projectile.

56. An apparatus, according to claim 55, wherein the means for steering the projectile further comprises a plurality of fin assemblies.

57. An apparatus, according to claim 55, wherein the means for producing the mechanical output further comprises a yaw drive assembly and a pitch drive assembly.

58. An apparatus, according to claim 55, wherein the means for producing the mechanical output further comprises a roll drive assembly, a yaw drive assembly, and a pitch drive assembly.

59. An apparatus, according to claim 55, wherein the means for epicyclically linking further comprises a planetary drive train.

60. An apparatus, according to claim 55, further comprising:

means for calculating the pitch and the yaw of the trajectory coupled with the means for producing the mechanical output;

means for sensing a positional configuration of the means for steering the projectile interconnected with the means for calculating;

means for supplying power to the means for producing the mechanical output, the means for calculating, and the means for sensing.

61. An apparatus, according to claim 60, wherein the means for calculating further comprises a trajectory controller capable of outputting signals to the means for producing the mechanical output.

62. An apparatus, according to claim 60, wherein the means for sensing further comprises a plurality of position sensors.

63. An apparatus, according to claim 60, wherein the means for supplying power further comprises a battery.

64. An apparatus, according to claim 60, further comprising means for conditioning signals transmitted between the means for calculating, the means for sensing, and the means for supplying power.

65. An apparatus, according to claim 64, wherein the means for conditioning signals further comprises an electrical conditioning system.

66. An apparatus, according to claim 55, further comprising:

means for calculating the roll, the pitch, and the yaw of the trajectory coupled with the means for producing the mechanical output;

means for sensing a positional configuration of the means for steering the projectile interconnected with the means for calculating;

means for supplying power to the means for producing the mechanical output, the means for calculating, and the means for sensing.

67. An apparatus, according to claim 66, wherein the means for calculating further comprises a trajectory controller capable of outputting signals to the means for producing the mechanical output.

68. An apparatus, according to claim 66, wherein the means for sensing further comprises a plurality of position sensors.

69. An apparatus, according to claim 66, wherein the means for supplying power further comprises a battery.

70. An apparatus, according to claim 66, further comprising means for conditioning signals transmitted between the means for calculating, the means for sensing, and the means for supplying power.

71. An apparatus, according to claim 70, wherein the means for conditioning signals further comprises an electrical conditioning system.

* * * * *